US007717310B2

(12) United States Patent
Zalinsky et al.

(10) Patent No.: US 7,717,310 B2
(45) Date of Patent: May 18, 2010

(54) AIR-CUSHION BACKPACK

(75) Inventors: Lawrence W. Zalinsky, Woodstock, NY (US); Kathleen V. Gee, Woodstock, NY (US); Richard J. Rekuc, Asbury, NY (US)

(73) Assignee: E. Mishan & Sons, Inc., New York, NY (US)

( * ) Notice: Subject to any disclaimer, the term of this patent is extended or adjusted under 35 U.S.C. 154(b) by 1098 days.

(21) Appl. No.: 11/377,008

(22) Filed: Mar. 16, 2006

(65) Prior Publication Data

US 2007/0215662 A1 Sep. 20, 2007

(51) Int. Cl.
*A45F 3/04* (2006.01)

(52) U.S. Cl. ..... 224/644; 224/642; 224/643; 224/627; 224/261

(58) Field of Classification Search ..... 244/907, 244/644, 643, 265; 441/111
See application file for complete search history.

(56) References Cited

U.S. PATENT DOCUMENTS

| | | | | | |
|---|---|---|---|---|---|
| 900,610 | A | * | 10/1908 | Stow | 224/264 |
| 1,444,157 | A | * | 2/1923 | Lee | 224/264 |
| 3,679,108 | A | * | 7/1972 | Ingram | 224/644 |
| 3,964,266 | A | | 6/1976 | Bartlett | |
| 4,750,654 | A | | 6/1988 | Menetrier | |
| 5,320,262 | A | * | 6/1994 | Levis | 224/630 |
| 5,400,934 | A | * | 3/1995 | Ducros | 224/148.2 |
| 5,547,461 | A | * | 8/1996 | Levis | 602/19 |
| 5,577,648 | A | * | 11/1996 | Sason et al. | 224/637 |
| 5,722,573 | A | * | 3/1998 | Carnel | 224/148.2 |
| 5,901,889 | A | * | 5/1999 | Ho | 224/148.2 |
| 5,957,356 | A | * | 9/1999 | Potempa | 224/643 |
| 5,975,387 | A | * | 11/1999 | Gleason et al. | 224/148.2 |
| 6,109,495 | A | * | 8/2000 | Hernandez | 224/644 |
| 6,168,056 | B1 | * | 1/2001 | Bertholon | 224/264 |
| 6,173,671 | B1 | | 1/2001 | Casull | |
| 6,471,105 | B1 | | 10/2002 | Ammerman | |
| 6,527,480 | B2 | * | 3/2003 | Angelini et al. | 405/186 |
| 6,793,112 | B2 | | 9/2004 | Ammerman | |
| 6,820,783 | B2 | * | 11/2004 | Beale | 224/644 |
| 6,863,202 | B2 | | 3/2005 | Ammerman | |
| 7,631,792 | B2 | * | 12/2009 | Christy | 224/644 |
| 2002/0074374 | A1 | * | 6/2002 | Holbl | 224/644 |
| 2002/0158097 | A1 | * | 10/2002 | Beale | 224/644 |
| 2006/0040574 | A1 | * | 2/2006 | O'Meara et al. | 441/88 |
| 2006/0049226 | A1 | * | 3/2006 | Marik | 224/637 |

* cited by examiner

*Primary Examiner*—Nathan J Newhouse
*Assistant Examiner*—Peter Helvey
(74) *Attorney, Agent, or Firm*—Notaro & Michalos P.C.

(57) ABSTRACT

A backpack has a generally rigid support having a front face and a back face, shoulder straps attached to the support for holding same against a back of a user, and structure on the back face for holding an object. A pressurizable and flexible bladder covers generally all of the front face of the support and has a closable fill opening. This bladder is secured to the front face of the support with the fill opening accessible.

14 Claims, 8 Drawing Sheets

AIR-CUSHION BACKPACK

FIELD THE INVENTION

The present invention relates to a system for carrying one or more objects on the back. More particularly this invention concerns a backpack.

BACKGROUND OF THE INVENTION

It is frequently convenient to carry something on one's back. This way it is possible to manage a fairly large and even heavy load while still leaving the hands free with the load set so that the person carrying it can walk naturally. This is done when camping to carry one's camping gear, in the military for transporting equipment such as radios, by school children who often carry their books in a pack, and in marching bands where members often have instruments, e.g. drums, carried on the back, and it is standard for guitars and similar instruments to be carried this way.

A typical backpack, the most common system employed for carrying something on the back, comprises a semirigid support, which may be formed as an open frame or an imperforate panel, having a front face and a back face. Straps attached to the support go over the user's shoulders and retain the support with its front face engaging the user's back and the back face turned rearward away from the user. A bag and various attachments are provided on the rear face for holding whatever is being transported. A similar system is used for carrying a bass drum in a marching band or a two-way radio on a military patrol.

A major issue with a backpack is comfort. The human back varies considerably from person to person, and two people of the same height and weight are likely to find different backpacks more comfortable than others. Hence it is standard to provide various elements of adjustable padding, numerous ways to adjust and position the shoulder straps, and so on in order that the backpack can be made comfortable for a given wearer.

All the known systems require that the user not only make various adjustments to the pack and its padding, but also that the user know what adjustments to make. The result is that only the most experienced users of backpacks have truly found something that is comfortable, and even so what is comfortable one day with a given load might be uncomfortable the next, or with a different load.

Another significant problem with backpacks, particularly encountered when used by children, is that the considerable load is applied to the user in such a manner as to be unhealthy. A young back can actually be injured by carrying a big pack that applies the weight in a single location, and in general the packs can rub in spots and become quite uncomfortable.

OBJECTS OF THE INVENTION

It is therefore an object of the present invention to provide an improved system for carrying something on the back.

A further object is an improved backpack.

Another object is the provision of such an improved backpack that overcomes the above-given disadvantages, in particular that is extremely comfortable and that does not require extensive adjustment.

SUMMARY OF THE INVENTION

A backpack has a generally rigid support having a front face and a back face, shoulder straps attached to the support for holding same against a back of a user, and structure on the back face for holding an object. According to the invention a pressurizable and flexible bladder covers generally all of the front face of the support and has a closable fill opening. This bladder is secured to the front face of the support with the fill opening accessible.

With this system, therefore, the air-filled bladder lies between the user's back and the support of the backpack. Thus this hard part does not come into contact with the user's back. The result is a very, very comfortable fit.

According to the invention the back face is provided with a bag having an openable closure. The back face can alternately have a mount for a musical instrument or other piece of equipment.

The support is a generally imperforate plate of a semirigid plastic. This ensures that the air-filled bladder is supported over its entire back face and that any irregular objects or the like bearing against the back face of support are not able to contact the user or even the bladder.

The bladder is held in place by a pocket constituted by a flexible textile panel or front wall having outer edges secured to the support. The bladder is retained in this pocket, normally along with the support plate. An openable fastener on this pocket makes it possible, if necessary to take out and replace or repair the bladder if, for instance, it is punctured. For comfort, the front wall of the pocket is made of mesh, preferably stretchy.

The bladder in accordance with the invention can be provided with an elongated fill tube having an end forming the fill opening. This fill tube extends along at least one of the straps to a front region of the backpack. To prevent compression and blocking of the fill tube, the one strap is provided with a semirigid reinforcing channel accommodating the tube.

The fill opening is provided with a normally closed valve. This valve is an openable check valve so that the bladder can be blown up until it is quite full and even relatively hard. Then according to the invention while the pack is on the user's back, he or she lets out some of the air so the pack settles into place in what is a very comfortable manner. It has in fact been surprisingly discovered that the pack is much more comfortable when the bladder has been partially deflated than when it is relatively full and slightly hard. When deflated, the pack actually settles against the user's back and conforms perfectly to the shape of the back and the user's own posture, and even changes shape as the user moves to maintain this perfect fit. The load in or on the pack is thus distributed perfectly uniformly. With a shoulder-mount valve as described above, the pack can even be reinflated without taking it off.

The stretchable textile front panel forms a pocket holding the bladder. In addition a textile rear panel forms the pocket with the front panel, and both the support and the bladder is contained in the pocket.

For maximum comfort the bladder is also subdivided into a plurality of interconnected compartments. They include a relatively large lower compartment and a plurality of relatively small upper compartments. What is more, the center of the bladder is somewhat recessed so that there is more air circulation here and the pack does not trap hot air against the user's back.

It is also possible for the pocket to be downwardly open, in which case backpack further has a releasable fastener, e.g. velcro, at a lower edge of the front panel. Moreover the bladder is flexible but generally inelastic. Thus when deflated it holds a shape, and when full it can get fairly hard.

BRIEF DESCRIPTION OF THE DRAWING

The above and other objects, features, and advantages will become more readily apparent from the following description, it being understood that any feature described with reference to one embodiment of the invention can be used where possible with any other embodiment and that reference numerals or letters not specifically mentioned with reference to one figure but identical to those of another refer to structure that is functionally if not structurally identical. In the accompanying drawing.

SPECIFIC DESCRIPTION

Figure 1:
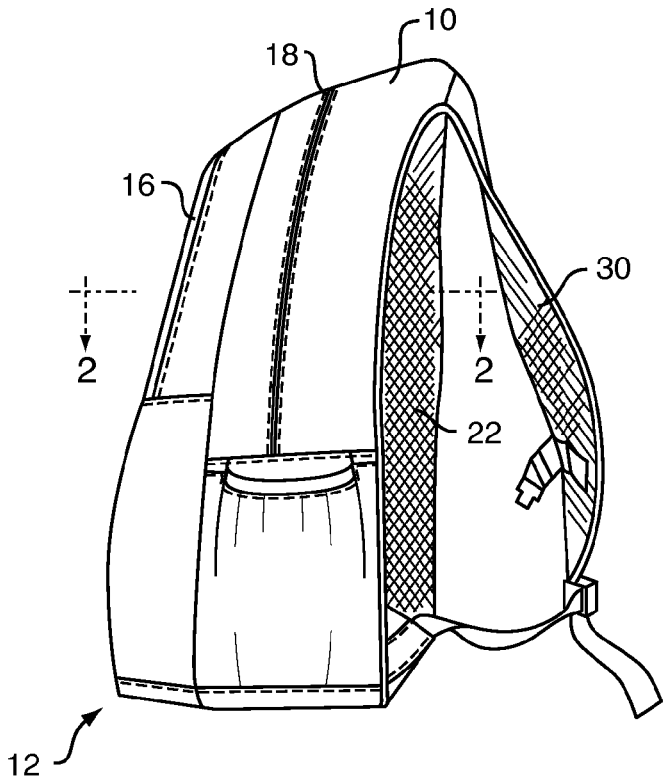
FIG. 1 is a small-scale side view of a backpack according to the invention with the cushion deflated.
Figure 2:
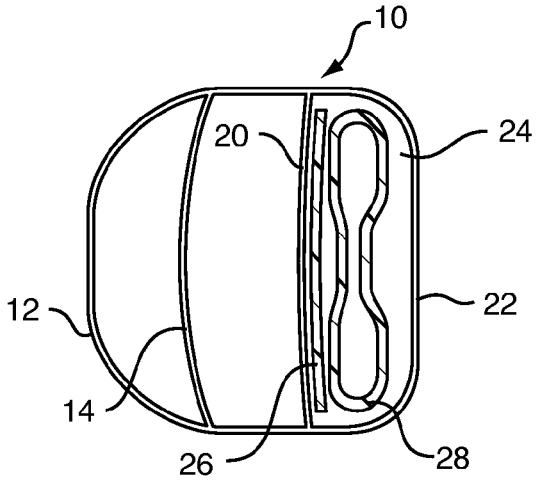
FIG. 2 is a horizontal section taken along line II-II of FIG. 1.
Figure 3:
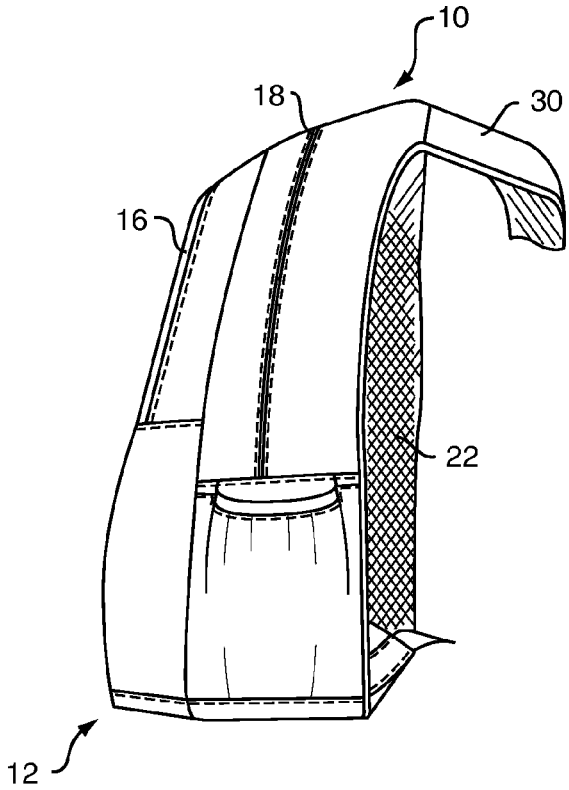
FIG. 3 is a view like FIG. 1 of the backpack with the cushion inflated.
Figure 4:
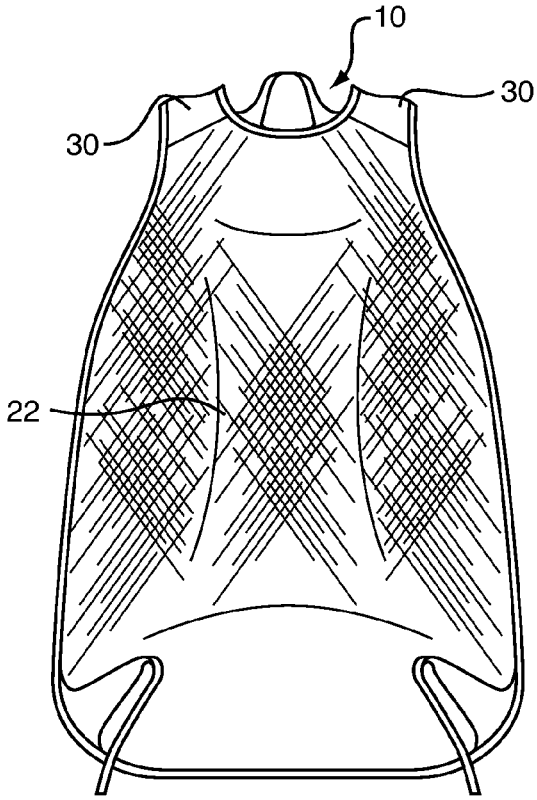
FIG. 4 is a front view taken in the direction of arrow IV of FIG. 3.
Figure 5:
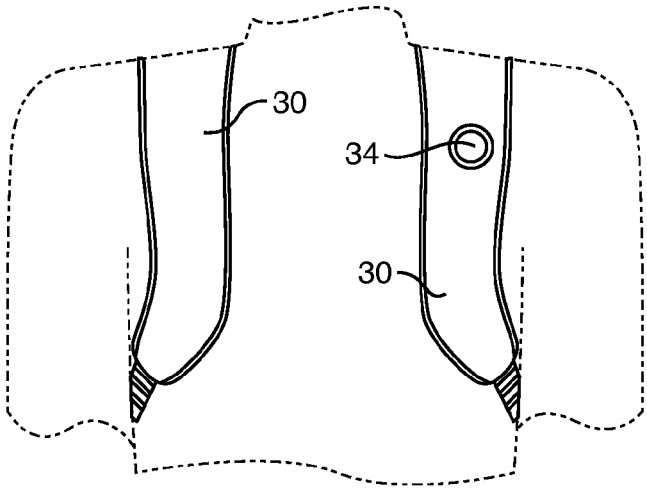
FIG. 5 is a small-scale partial front view illustrating the pack of FIGS. 1-4 on a person.

As seen in FIGS. 1 to 6, a backpack 10 according to the invention has a bag-forming rear wall 12 provided with an interior partition 14 subdividing its interior into a pair of compartments accessible via respective slide fasteners 16 and 18. Internally the backpack has a textile front wall 20 (see FIG. 2). Forward of this wall 20 another front wall or panel 22 made of mesh defines a front pocket 24 holding as will be described below a rigid and imperforate semirigid plastic plate 26 and an inflatable bladder 28. A pair of standard shoulder straps 30 have upper ends secured at the top of the rear wall 12 and lower ends at the lower edge of the front wall 22. Instead of the rear wall 12, the system of this invention could of course be used to carry a musical instrument, piece of equipment, or virtually anything typically carried on the back.

Figure 6:
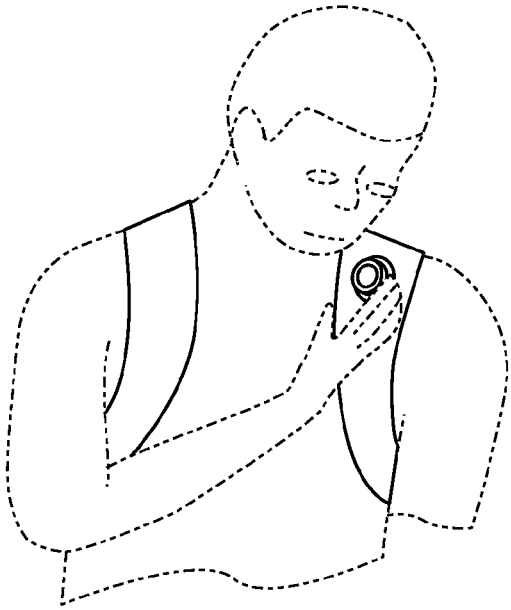
FIG. 6 is a view like FIG. 5 illustrating use of the backpack.

The bladder 28 according to the invention is made of a flexible but relatively inelastic plastic, e.g. vinyl. As shown in FIGS. 10 to 14 it has a lower region 28*a* that is substantially thicker than an upper region 28*b* when fully inflated as shown in FIG. 14 to provide a good cushion at the kidney level of a wearer of the pack 10. In addition the bladder 28 has a somewhat recessed central area 28*c* and raised side regions 28*d*. Projecting from one corner is a tubular extension 32 provided on its outer end with an openable check valve 34. As indicated also in FIGS. 5 and 6 this tube 32 is received in one of the straps 30 which is tubular and set up to expose the valve 34 at the front so that a user wearing the pack 10 can blow into it as shown in FIG. 6. In order to prevent the flexible extension 32 from being pinched closed where it passes over the user's shoulder the strap 30 is provided internally with a U-section semi-rigid liner 36 having a foam edge 38 and stitched in place so that in this region where the strap 30 is normally compressed by the weight of the pack 10 the tube 32 is held open at a semi-rigid channel formed under liner 36.

Figure 13:
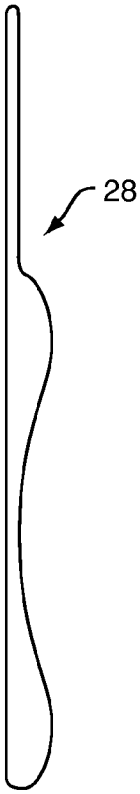
FIGS. 13 and 14 are side views of the bladder taken in the direction of arrow XIII of FIG. 10, in the deflated and inflated conditions, respectively.
Figure 14:
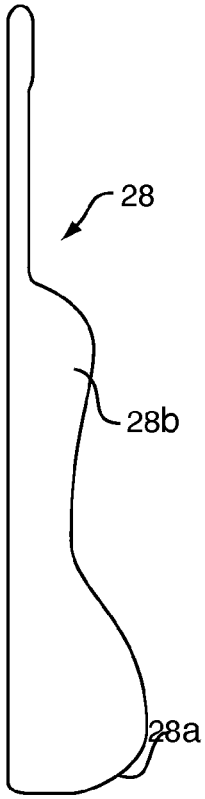
Figure 15:
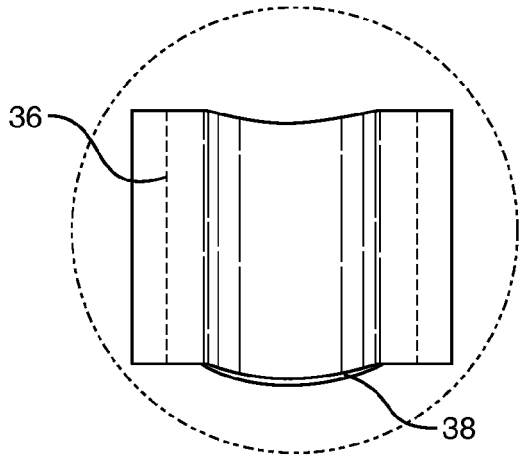
FIG. 15 is a large-scale view of the fitting used at the location indicated at XV in FIG. 10.
Figure 16:
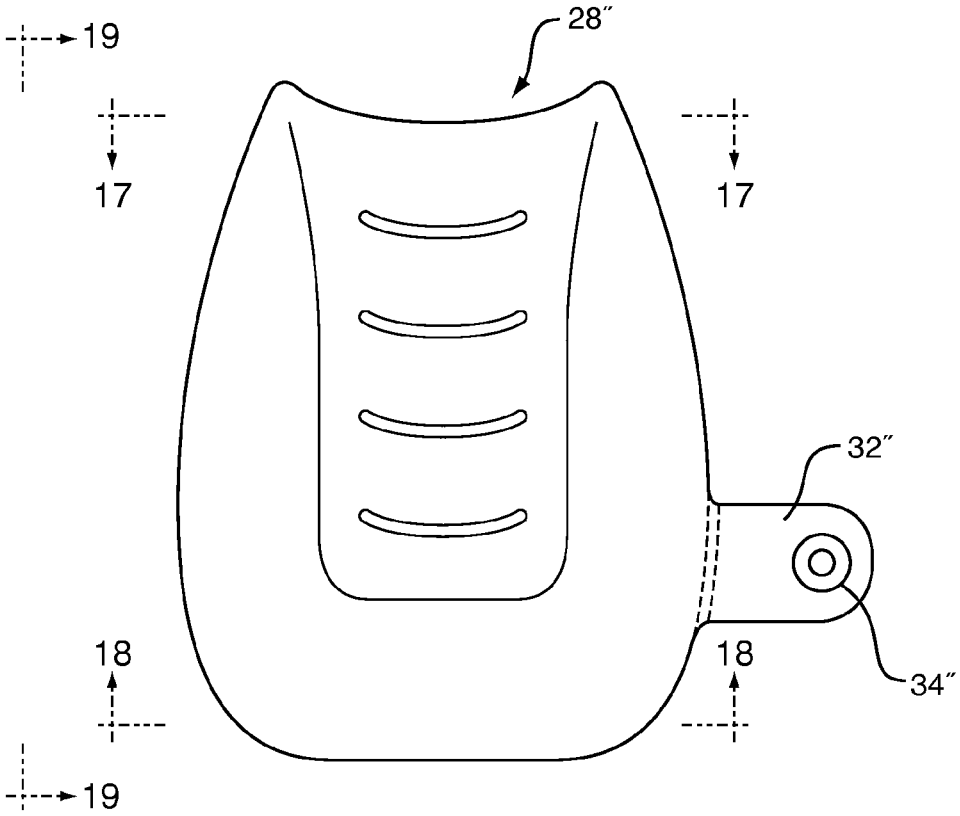
FIG. 16 is a front view of another bladder according to the invention.
Figure 17:
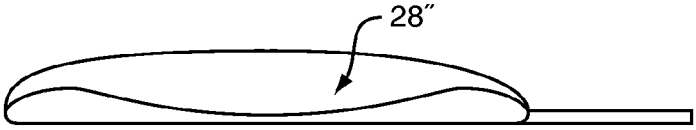
FIGS. 17 and 18 are sections taken along respective lines XVII-XVII and XVIII-XVIII of FIG. 16.
Figure 18:
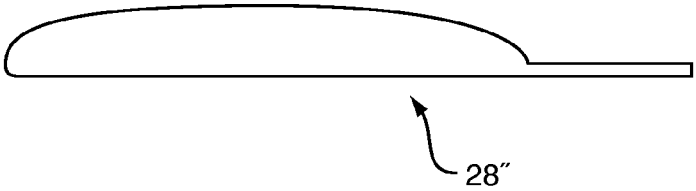
Figure 19:
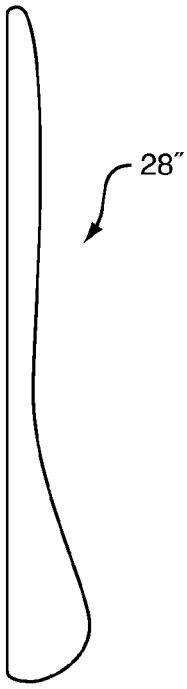
FIG. 19 is a side view taken in the direction of arrow XIX of FIG. 16.

With this system it is therefore possible to inflate the bladder 28 from the relatively flat and flaccid condition shown in FIG. 13 to the relatively full and even moderately hard condition shown in FIG. 14. This can be done before the pack is put on, or afterward. Once the backpack 10 is put on by passing the user's arms through the straps 30 so that the front mesh panel 22 overlying the bladder 28 rests against the user's back, the valve 34 is be actuated, for instance by pressing down in its center, to relieve some of the pressure. This causes the backpack 10 to settle against the user's back and assume a position in effected molded to the user. In this position the weight of the pack and its contents is applied uniformly to the entire back of the user, eliminating any concentrated load that could be injurious or, at the very least, uncomfortable.

Figure 7:
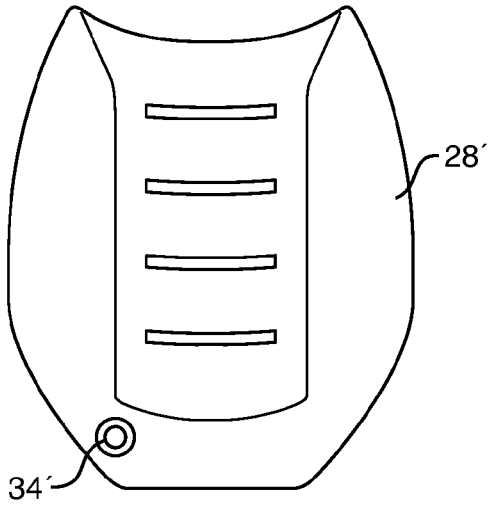
FIG. 7 is a front view of another bladder according to the invention.
Figure 8:
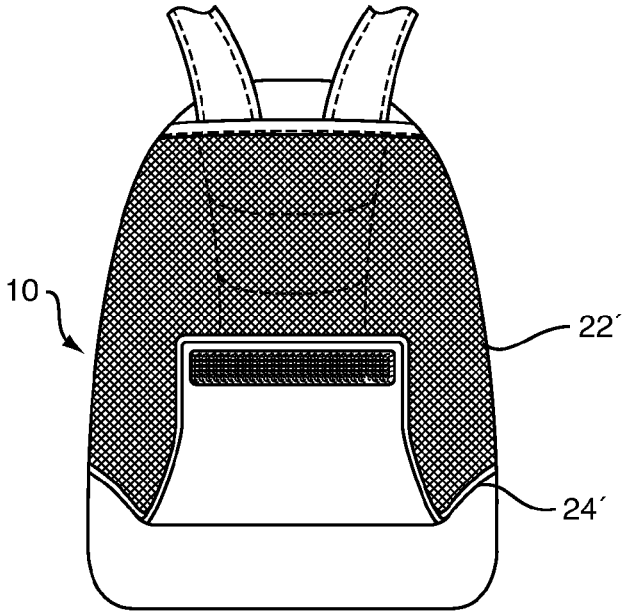
FIGS. 8 and 9 are front views of a pack employing the bladder of FIG. 7 in two different positions.
Figure 9:
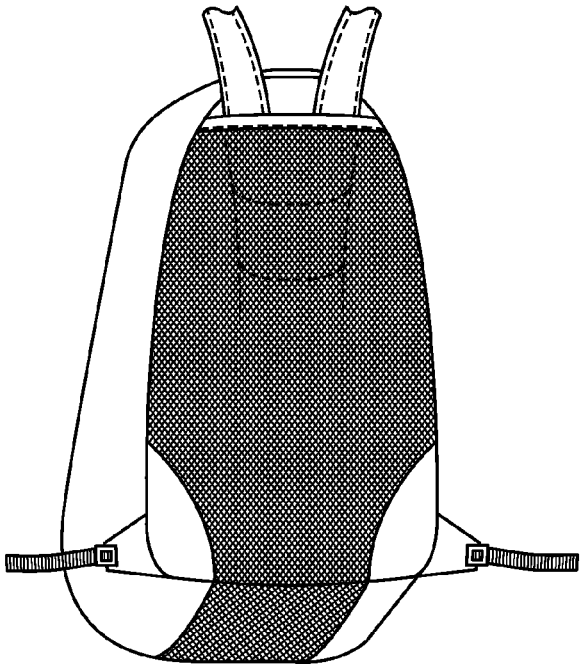
Figure 10:
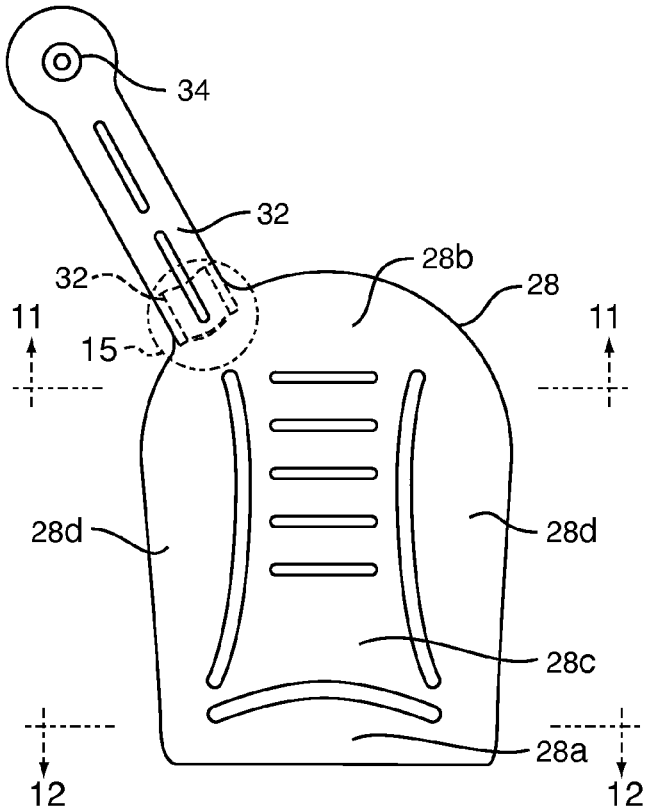
FIG. 10 is a rear view of the bladder of the pack of FIGS. 1 to 6.
Figure 11:
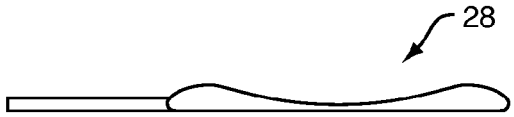
FIGS. 11 and 12 are sections taken along respective lines XI-XI and XII-XII of FIG. 10.
Figure 12:
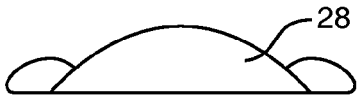

FIGS. 7 to 9 show another arrangement where a bladder 28' is provided in a lower corner with the valve 34' and does not have the tubular over-the-shoulder extension 32. Here a pocket 24' is formed by a front panel 22' that is open downward and that can be closed over the bladder 28' by securing it via a velcro fastener 23 to the bottom of the pack 10. Such an arrangement also has an unillustrated rigid plate 26.

FIGS. 16 through 19 show yet another bladder 28" with a lateral short extension 32" provided with a valve 34". With this arrangement the unillustrated front panel 22 is formed with an aperture through which the extension 32" can extend for operation of the valve 34".

Use of the backpacks with the bladders 28' and 28" is the same as that with the bladder 28, that is the bladder is blown up hard to start with and then deflated partially for comfortable use.

We claim:

1. A backpack comprising:

a first front wall (20);

a second front wall (22) spaced forwardly of the first front wall and defining a front pocket (24) with the first front wall;

a generally rigid plate (26) having a front face and a back face, the plate being in the front pocket (24) with the back face of the plate being adjacent the first front wall (20);

at least one shoulder strap (30) operatively connected to at least one of the front walls for holding the plate against a back of a user with the second front wall (22) being between the plate and the back of the user;

load bearing means connected to at least one of the front walls for holding an object;

a pressurizable and flexible bladder (28) covering generally all of the front face of the plate, the bladder being in the front pocket between the front face of the plate and the second front wall;

a tubular extension (32) extending from the bladder (28) and into the at least one shoulder strap (30) for inflating and deflating the bladder;

an openable and closable check valve (34) connected to the tubular extension at a location that is spaced from the bladder and positioned so as to be accessible to a user for inflating the bladder by blowing into the check valve while the shoulder strap is on a shoulder of the user; and a U-shaped semi-rigid liner (36) inside the material of the shoulder strap near the bladder to form a semi-rigid channel for receiving the tubular extension (32) in the liner, the length of the liner (36) being less than the length of the shoulder strap (30) and the liner being adjacent the iunction between the tubular extension (32) and the bladder (28) to facilitate inflating and deflating of the bladder through the tubular extension by preventing the tubular extension from being pinched closed.

2. The backpack defined in claim 1 wherein the load bearing means is a bag fixed to at least one of the first and second front walls behind the back face and having an openable closure.

3. The backpack defined in claim 1 wherein the plate is an imperforate semirigid plastic plate.

4. The backpack defined in claim 1 wherein at least one front wall of the front pocket is made of mesh.

5. The backpack defined in claim 1 wherein the valve is a check valve that normally prevents air from escaping from the bladder and that is manually operable to allow air to escape from the bladder.

6. The backpack defined in claim 1 wherein the second front wall (22) is a stretchable textile front panel forming the front pocket holding the bladder.

7. The backpack defined in claim 6 wherein the load bearing means includes a textile rear panel forming a rear pocket with the first front panel.

8. The backpack defined in claim 7, further comprising a slide fastener closing an end of the rear pocket.

9. The backpack defined in claim 6 wherein the second front panel is a mesh.

10. The backpack defined in claim 6 wherein the bladder is subdivided into a plurality of interconnected compartments.

11. The backpack defined in claim 1 wherein the bladder is subdivided into a plurality of interconnected compartments and the compartments include a relatively large lower compartment and a plurality of relatively small upper compartments.

12. The backpack defined in claim 6 wherein the front pocket is downwardly open and the backpack further comprises a releasable fastener at a lower edge of the front panel.

13. The backpack defined in claim 1 wherein the bladder is flexible but generally inelastic.

14. The backpack defined in claim 13 wherein the bladder is formed with a forwardly open central recess.

* * * * *